United States Patent [19]

Chaise

[11] Patent Number: 4,581,774

[45] Date of Patent: Apr. 15, 1986

[54] MOTORCYCLIST HELMET FITTED WITH A RETAINING DEVICE WITHOUT CHIN STRAP

[76] Inventor: Francois Chaise, Grandvaux, Palinges, France, 74130

[21] Appl. No.: 491,336

[22] PCT Filed: Aug. 18, 1982

[86] PCT No.: PCT/FR82/00137

§ 371 Date: Apr. 19, 1983

§ 102(e) Date: Apr. 19, 1983

[87] PCT Pub. No.: WO83/00605

PCT Pub. Date: Mar. 3, 1983

[30] Foreign Application Priority Data

| | | | |
|---|---|---|---|
| Aug. 19, 1981 | [FR] | France | 81 16135 |
| Aug. 19, 1981 | [FR] | France | 81 16136 |
| Jul. 20, 1982 | [FR] | France | 82 12855 |

[51] Int. Cl.[4] ..... A42B 3/02

[52] U.S. Cl. ..... 2/421; 2/6; 2/424

[58] Field of Search ..... 2/421, 424, 411, 425, 2/410, 10, 6

[56] References Cited

U.S. PATENT DOCUMENTS

| | | | |
|---|---|---|---|
| 4,290,150 | 9/1981 | Guerre-Berthelot | 2/421 |

FOREIGN PATENT DOCUMENTS

| | | | |
|---|---|---|---|
| 0960002 | 12/1974 | Canada | 2/411 |
| 2853260 | 12/1980 | Fed. Rep. of Germany . | |
| 2320066 | 3/1977 | France . | |
| 2371894 | 6/1978 | France . | |
| 7304625 | 10/1974 | Netherlands . | |
| 2087712 | 6/1982 | United Kingdom | 2/421 |
| 2119229 | 11/1983 | United Kingdom | 2/421 |

*Primary Examiner*—Peter Nerbun

*Attorney, Agent, or Firm*—Sandler & Greenblum

[57] ABSTRACT

A protective motorcycle helmet is provided which has a collar or bead which is substantially concentric with the opening of the shell base of the motorcycle helmet. The perimeter of the collar is a constant and when the helmet is locked in a closed position can open at one point over its circumference in order to remove the helmet from a user and to place it on a user. At least one flexible element extends about the circumference of the helmet shell base. These flexible elements are connected to one end to the helmet shell and at the other end to the collar. This ensures connection between the two elements.

41 Claims, 15 Drawing Figures

MOTORCYCLIST HELMET FITTED WITH A RETAINING DEVICE WITHOUT CHIN STRAP

BACKGROUND OF THE DISCLOSURE

1. Field of the Invention

The present invention relates to a motorcycle helmet which is fitted with a retaining device which allows it to improve its position on a user as well as assuring that it will remain on the user.

2. Discussion of Prior Art

Conventional helmet fasteners comprise a simple chin strap comprised of two ribbons of material or strips of leather which are integrally attached at one of their respective ends to the base of the helmet shell and at two lateral points away on a on an opposed portion of the shell. Free ends of the ribbons or strips fit together under the chin of the user and are attached by a buckle or other suitable element. Besides the fact that these types of helmets do not offer protection for the lower part of the chin of the user, this uncomfortable apparatus is even more so when tightened to a degree sufficient to insure that it will effectively will maintain the helmet on the user. Even in this case, the points at which the chin straps are anchored to the helmet shell are all offset with respect to the transverse median plane of the brain pan of a user, and the helmet will therefore have a tendency when it undergoes a shock to rock frontwardly from the back of the helmet after it rotatably moves about an axis which extends generally near the ears of the wearer of the helmet. Such an apparatus does not prevent the helmet from leaving the head of the user when the helmet undergoes a simple shock or after bouncing. Moreover, when the helmet undergoes a pulling force directed from the base of the helmet towards its top, the force is integrally transmitted to the lower portion of the chin of the user, the pressure being dangerous to the weak surface of the chin strap through which the pressure is applied. This apparatus is as uncomfortable as it is dangerous and has previously been improved by the use of a helmet fastening apparatus which essentially comprises a rigid skirt formed as an extension of the base of the helmet shell and which comprises two journalled sections, one located in the front of and the other behind, the shell. These two sections are locked by their moveable ends along lateral zones of the same shell. Even this apparatus, however, is inconvenient. The elements which permit activation of the locking apparatus are easily accessible from the outside of the helmet, and when they undergo a shock can contact the rough portion of the ground, with unlocking and possible opening of at least one section of each half skirt resulting therefrom. In addition, when the helmet is put on and removed, particularly if the user of the helmet is dressed in hot clothes such as pullovers or jackets having turned up collars (which is normal for a motorcyclist), the users will be uncomfortable due to the amplitude of movement described by the ends of each half-skirt when it is opened and closed. The presence of small tongues, equipped with hooks and integrally attached to the ends of the rear half-skirt, render the operation more delicate, since garments, e.g., sweaters, often rip when one of the hooks unfortunately engages a stitch of such garment. Lastly, the use of a rigid skirt makes it necessary to provide protection for the neck of the user against contact with the section of the skirt via a shock absorbing system and a thick, flexible from filling which is interposed between it and the neck of the wearer of the helmet. Because of this, the perimeter of the section defined by the edge of the skirt is itself substantially greater than the perimeter of the neck that it is intended to surround. Retention is thus not assured in an effective fashion, particularly at the front of the helmet, except by the flexing foam filling resting along its upper surface against the lower surface of the chin of the user. Even the smallest shock which exposes the helmet to a torque suffices to deform the filling in such a way that the user can see his helmet if not removed from his head, at least rock forwardly from the rear until the retention system rests against the lower surface of his nose. Such a situation is at least uncomfortable and dangerous, particularly if the user wears a pair of glasses, the upper portion of the glasses potentially being crushed against the eyebrow ridges. Additionally, helmets of this type cannot benefit from anti-theft systems which have been adopted by all manufacturers of modern motorcycles and which simply consist of an anti-theft hook integrally attached to the machine and provided so that a user can hook the metallic buckle of the helmet thereto, simply attaching it into the chin strap of all ordinary protection helmets. Such a system is not effective for all tests, as it is easy for a potential thief to cut the chin strap in order to steal the helmet. However, this apparatus reduces the risk of theft by a certain degree, and is particulary advantageous in having been adapted unanimously by the manufacturers of motorcycles without imposing on the helmet manufacturers the requirement to modify their products. It can thus be seen that all owners of helmets finished with a fastening apparatus without a chin strap, and thus without an attachment buckle, cannot use the anti-theft hook with which motorcycles are equipped; instead they all must buy a supplemental, anti-theft accessory which is expensive, heavy and cumbersome and which generally consists of a large chain or metallic buckle extending on one hand around the chin portion of the helmet for protection and on the other hand around the stationary portion of the motorcycle. These helmets are already among the most expensive on the market, requiring additional cost for such an anti-theft accessory, or failing that, obligating users to walk around with their helmets at each stop. This causes a fairly large number of potential customers to opt for a conventional helmet which is equipped with a fastening apparatus without a chin strap.

The helmet of the present invention benefits from an improved fastening apparatus, which according to the variations envisioned, avoids all of any of the shortcomings inherent in prior techniques and insures that they are able to completely fulfill the role of protecting the brain pan of the user, regardless of the forces that it can undergo during a simple shock or after bouncing, particularly during a fall.

According to a preferred variation of the invention, this apparatus is characterized in that it essentially comprises a bead substantially formed in the shape of a toroid, concentric with the opening defined by the lower end of the helmet shell when the helmet is closed. This bead is connected to the shell base by means of one or more flexible elements, and comprises one or more sections which are assembled end to end when the helmet is closed, and which thus form a type of collar about the neck of the user, the base of the face of the user and his skull thus resting against the upper surface of the collar. The helmet is locked in a closed position, and in the perimeter of the bead cannot be changed. Each of the sections which comprises the entire bead can either be rigid or formed from a flexible material, at least in a plane parallel to that of the shell base; they are not extensible, flexible and elastic, but are instead equipped with a flexible core, at least in a plane which is parallel to that of the helmet base, which is not itself extensible. In all cases the bead is covered with a certain thickness of padding providing an element of comfort and security at least in the areas of its outer surface which are likely to contact the user. If the bead is formed by two or more sections, each of which can be journalled (and particularly if the bead is rigid) at one of its ends to the end of an adjacent section, an end of at least one section is unlockable from the end of the section against which it comes to rest when locked (this in order to permit the opening of the collar which comprises the closed bead). If the bead comprises two or more sections, the two ends of each section can be maintained stationary, and the helmet closed and locked against one or more adjacent sections, thereby completely unlocking (without journalling) and permitting the helmet to open. In the case where the bead is a single unit and is split at a single point (e.g., a flexible bead), the two ends defined by this split come to rest against each other and are held there by a locking system (e.g., a collar) and after having been unlocked can be moved away from each other (when the collar opens) due to the elastic deformation which is imposed on the bead in order to proceed with removal of the helmet.

According to a simplified variation of the helmet in accordance with the invention, the bead is flexible, which amounts to, e.g., a thin strip of material or leather, which is either flat or rolled.

According to a second variation, the bead itself only extends around a section of the perimeter of the collar, a complementary section of the collar being a rigid skirt, either mobile or stationary, which is equipped with a filling; or only a section of the inner filling of the helmet extends towards the shell base and towards the inside of the helmet to form, e.g., a nape bead at the back of the helmet.

In this type of embodiment, the bead section itself can amount to, e.g., two independent bead sections when they are in an open position and which are joined end to end, or from each end of an extension of the helmet base when in a closed position. These bead portions are thus connected or journalled at their other ends to an extension of the shell base or to ends of the the naped bead with which they are associated.

According to one particular embodiment, the bead is rigid, in at least two sections, each of which is journalled along a vertical axis carried by an extension of the shell base. The opening of these bead portions can automatically occur due to the action of an elastic apparatus, e.g., a spring which causes this opening as soon as unlocking occurs.

In such an embodiment, each portion of the bead itself is extended, potentially along its entire length, by a rigid flap which joins the helmet shell base and which is able, due to its complementary shape, to be hooked when the helmet is locked in a closed position. The flexible elements which were questionable are thus considered to be nonexistent in such case.

In all cases the ends of two adjacent sections can also become stationary, or be journalled at each end of an intermediate rigid piece which is integrally attached with any of the following: an extension of the shelf; or with a rigid piece journalled to the shell base; or with an assembly of several rigid pieces journalled among themselves, at least one of which is journalled to the shell base; or to a flexible element connected at its upper end to the shell base. The end of each of the sections, if it does not carry a journal cooperating with an end of another section, carries a bolt section which cooperates with a complementary section which is integrally attached to an adjacent section or with an intermediate piece between the sections and with the end of an adjacent section. In a case where each bead section is equipped with a flexible or nonextensible core, the bolt section which is integrally attached to one end of the shell section can be carried by an end of the flexible core.

According to another embodiment of the invention, a flexible frame can also be integrally attached, e.g. at its center or at its end, to the following: a shell extension; or with a rigid piece which is journalled to a shell base; or with an assembly of rigid pieces which are journalled among themselves and which are journalled to the shell base; or to a flexible piece which is connected to its upper end to the shell base. In this case, one or more ends of the frame are engaged in a tubular conduit which is located longitudinally within a bead section and which opens at the end of the bead section; in this fashion the bead can slide about the frame during opening and closing of the shell. Each free end of the frame carries a bolt section which cooperates with a complimentary section integrally attached to the end of the bead section or with an intermediary piece, against which the other ends of the shell section which it intersects from end to end come to stop during closing of the helmet.

According to a second embodiment, each free end of such frame joins the end of one frame to the inside of the same bead when the helmet is closed. In this case, each frame end carries an identical bolt section which cooperates with a complementary section integrally attached to the bead in order to permit the two ends to be joined to each other.

According to a first embodiment of the invention, the bolt can be a cylindrical piece which is bevelled and which includes a circular groove which has a reduced its diameter along a portion of its length. This cylinder is integrally attached to one of the sections to be connected and is introduced during closing of the helmet into a complementary hollow cylinder located in the other section to be connected. The side of this hollow cylinder comprises a perpendicular side along its axis through which a tongue extends. The tongue can be biased by a spring and can have a end which is directed towards the inside of the cylinder. This tongue end can have a semi-circular profile with an axis which is parallel to the axis of the cylinder and a diameter which is substantially equal to the diameter of the hollow cylindrical portion of the zone which is reduced by the groove. In a locked position, the tongue will engage the groove of the cylinder and will prevent it from disengaging the hollow cylinder. Unlocking occurs due to a maneuvering element which is integrally attached to the tongue and which permits the tongue to be pulled rearwardly towards the outside of the cylinder. Each flexible frame is integrally attached to a rigid extension which is journalled or flexibly connected to the shell base, and which slides within a tubular bolt section during opening and closing movements; this device can be independent of the locking apparatus. Unlocking occurs due to the existence of a maneuvering element which is integrally attached to the tongue and which permits the tongue to be pulled rearwardly towards the outside of the cylinder. Each flexible frame which is integral with one of the rigid journalled or flexible extensions extends from the shell base and slides within a tubular bolt section during opening and closing movements which are independent of the locking apparatus. Effectively, the importance of such frames, even if they lack bolts is that they are necessary for the beneficial use of the helmet in accordance with the invention. Their essential function is to permit total and ample opening movements of the collar and easy closing for the collar while they transmit movement of the bead to the shell extension and reciprocally ensure that the same elements are centered and coincident when they come to rest against each other. According to one embodiment, the flexible frame slides in the tubular bead which extends through a bolt section which is itself tubular. It can be formed integrally with the end of the bead, can extend across the tubular bolt section, and can be integral with the same extension and can be journalled to the shell base as part of the frame itself, mounted concentrically to the bolt section.

According to a second embodiment, the flexible frame is integrally attached to an end of the bead and slides within another section of the bead, the journalled extension of the shell thus being removed.

According to a third embodiment, each flexible frame has a guiding element which comprises telescopic strands.

According to another embodiment, if the flexible frame is integrally attached to a shell extension comprising several rigid pieces journalled among themselves and journalled to the base and to the front of the helmet shell, when a hypothetical rear shock is undergone, the set of journals will not permit the various journal pieces to be stretched to the maximum towards the inside of the helmet, thereby causing the collar assembly to pull back sufficiently to avoid the danger of rupture of the spinal column of the user due to the shock of the nape against the rear portion of the collar. At least one of the journalled pieces in this case is formed from two pieces or from telescopic blades which can be stretched by sliding or slippage of one with respect to the other. An abutment apparatus is provided to prevent separation of the two partially free pieces in translational motion and a spring is provided to permit, even the a violent force present, the pieces to be maintained in a rest position and not stretched.

The connection between the bead and the helmet shell, with the exception of the case described above, is made by one or more flexible elements.

According to a first variation, the element is either flexible or elastic flap which is an extension of the shell base. The flap can be solid or perforated and can be connected to the helmet shell base in several ways: it can be connected by its upper part during molding, when a molded rubber flap is used; it can be connected by fastening or by wedging complementary shell and flap shapes; it can be connected by pinching two lips of the upper edge of the flap onto respective ends of the lower shell edge which are applied against the shell by complementary pieces, e.g., two flexible blades, one outside the other, on the inside of the helmet, which extend about the shell base along its entire circumference and which are connected to each other by rivets which pass through corresponding openings extending along the two blades, the two flap lips, and the edge of the shell; or it can be connected by any other process which is capable of establishing a connection, either temporary/collapsible or permanent, to effectively to resist substantial pulling forces. In the case of a molded elastic flap and an elastic bead, e.g., formed of rubber or any elastimer, the flap can be formed with a shape which extends the bead obtained during molding. If not, the connection between the bead and the lower edge of the flap can be made by in any form and by any method capable of insuring an effective connection, either temporary or permanent, which is also capable of resisting substantial pulling forces.

According to a first variation, particularly if the elastic flap is connected to the shell base and to the bead over a substantial portion or the entirety of the circumference the movement in accordance with which the bead and the flap are elastically deformed in order to permit the helmet to open being relatively complex. Thus, according to a particular embodiment of the helmet of this invention, after a user has unlocked the helmet he applies a torque to the bead or each section of the bead, which will tend to provide reversal of the torque towards the outside of the helmet. During this maneuver, the flap generally works compression in a zone in which forces are applied and by extension in the zones which are spaced from this point. The forces internal to the flap permit the bead, from the moment when it passes under the shell outside of the helmet, to establish a false balance position in moving to the outside of the helmet to be placed against the outer face of the helmet. For closing, a force is applied to the bead which tends to release it, thereby permitting it to spontaneously resume its closed position if such is the true balanced position of the helmet. The position that the flap-bead assembly adapts for such constraints, e.g., for use with a molded piece, is a position in the manufacturing mold defined as the true balance position. In this position, the internal forces to which the flap and the bead are subjected during their elastic deformation are rendered null at either a greater or a reduced residual tension.

In accordance with another variation, the opening movement can also move or simply occur in a single plane which is parallel to the shell base which extends by the open bead. The two defined branches on either side of this opening are held apart from each other. This movement can again have as many variations as there as possible types of embodiments. The nature, quality, and planes in which the movement develop are influenced by, e.g., the choice of a true balance position, other than the closed position, by the flexibility and elasticity of the bead, by the presence of profiles or sections missing at the level of the flap or the bead; in effect, in order that the apparatus can be maneuvered without too much effort, the flap should be split from its top to its bottom at least one time, and it can also be split at two points along its circumference. Each of the splits dividing the flap and the bed can be replaced by the simple supression of one of the bead sections alone, of the flap alone, or of both the flap and the bead. The elastic flap can also be reinforced at points, in the zones in which it will not be working in extension, by one or more flexible but non-extensible elements, e.g. material ribbons, or by including material or metallic wires which connect the upper part of the skirt (i.e., the helmet shell base to the lower part of the bead) following a path which cannot be either rectilinear or absolutely vertical. Moreover, each interruption of the flexible flap comprising the skirt (possibly having its edges or ends contoured) is reinforced by an increase in its thickness, e.g., following the form of a cylindrical ring. Such thickening, if it does not define a rectilinear contour, is itself provided longitudinally with a wire or with a small cylindrical cable which is countersunk in its center.

In one particular embodiment, the flexible flap, especially if formed from rubber, extends along the exterior of the shell over its entire surface. The helmet formed in this fashion has improved/aesthetic qualities and shock absorbing potential. Thus, the outer surface of the shell and the objects which are able to contact it, i.e., a motorcycle body, will no longer have to suffer from deterioration suffered generally by such contents.

According to a second variation of the invention, the connection between the helmet shell and the bead is insured by a least two flexible, non-extensible elements, e.g., material ribbons or leather strips.

According to a third variation of the invention, the connection between the helmet shell and the bead is together insured by providing at least one flexible, non-extensible element and over at least a portion of their perimeters, at least one or more flexible and elastic flaps, each of which flaps is able to be reinforced at points by one or more flexible, non-extensible elements.

According to a fourth variation of the invention, the position of the height of the beads with respect to the shell base is adjustable. Thus, when flexible and non-extensible elements are used, e.g., material ribbons which operate the connection between the bead and the shell, metallic buckle elements or other analogous adjustment systems can easily be used, in a similar fashion to the type of systems used in conventional chin straps.

According to a fifth variation of the invention, the perimeter of the bead in its closed and locked position is adjustable in order to adapt the morphology of the user. This is particularly necessary where the outer padding of the bead is not sufficient to compensate for the differences in shape. In all cases, when the neck of the user undergoes a shock due to abutment with the section of collar formed by the bead, it is the entire bead, due to the flexibility and elasticity of one or more elements which connect the element shell, which can move, terminating the concentric relationship of the opening defined by the lower shell edge. This performs a shock absorbing function, performed by the elasticity of the bead padding, which is thereby insured about the perimeter of the bead, and thus the retention quality which it insures is modified. In the case when the helmet undergoes a pulling force exerted from the bottom towards the top, the bead is connected to the shell by one or more damped elastic elements which will again undergo a shock which moves downwardly, thus completely assuring the continuing retention of the helmet on the head of the user due to the non-extensibility and the constant perimeter of the shell. Because the elastic flap is reinforced at points by one or more flexible, non-extensible elements as well as because the bead has one or more extensions attached at several points thereof, or because they are journalled in a rigid or flexible, non-extensible fashion with respect to the shell, the resistance of the helmet is increased due to such pulling forces and limits the amplitude of elastic deformation thereof.

Moreover, if it is true that the non-extensible character of the bead, when in a closed position, is the guage of the optimal quality of the retention of the helmet on a user, it is no less true that the helmet can still be operational with limits imposed by desired standards if the bead is extensible (although not excessively extensible).

In this way, according to one embodiment, the bead is formed from molded rubber without a non-extensible frame.

The problem of aeration and ventilation of the interior of the helmets has not previously been resolved in a satisfactory fashion due to the limitations imposed by the requirements of surface of profiles on the surface of helmet shell profiles which have been used. This is why in accordance with one embodiment of a helmet according to the invention, the flexible skirt is extended in each of two lateral zones, or the front lateral zone, beyond the perpendicular contour which is marked by the cylindrical wing previously defined, of an edge or an end of the skirt; the extension is provided by a small flexible flap connected to one hand to the shell base, and on the other end to the bead as well as to the flexible skirt. The height of the flap is greater towards its front and towards its rear and has a value greater than that of the remainder of the skirt in the zone where the flap is connected to it so that the flap will not prohibit preventing closing and opening of the helmet, and will not remain at an extension point of the skirt, but can be pulled towards the exterior of the shell where it attains a balance position which provides it with the appearance and the function of an air intake opening on the side of the helmet; such opening is located on the exterior of the helmet and has the slight form of a half-conical frustrum with its widest radial being open towards its front. Air captured by this structure is taken within a fairly large conduit located along the outer surface of a spherical portion comprising an inner filling for the helmet, and which opens along the base of the helmet in alignment with the extension of the air intake. Such a conduit, as it gets farther away from the helmet, is divided into several orifices which open within the helmet. These orifices have diameters which increase as they extend away from the zone in which the air intake is located.

According to another embodiment, a conduit opening at the helmet shell base is located at the outer surface of the spherical portion, extends across such portion, and extends towards the top of the helmet through several other conduits which are located on the inner surface of the spherical portion or along the exterior portion of the foam comfort filling which covers this portion of the sphere. In this embodiment the conduit openings on the helmet shell base can also, in accordance with the third variation, be located along the inner surface and the base of the spherical portion and open as closely as possible to the air intake described. The air which is conducted through these conduits is thereby harmoniously distributed over all of the inner surface of the helmet filling. However, in order to conserve and preserve the advantage of this helmet, which exists in cold weather or at great speeds, for a closed helmet (which exists in the absence of uncontrolled air), it suffices in such circumstances to push each of the two small flexible flaps, which are previously acted as air intake flaps, towards the inside of the helmet where they attain a second balance position. The second balance position is symmetrical with the preceding balance position, and in this position the flaps fulfill the inverse role, insofar as they act as air deflectors and closing devices for the conduit(s) which are located in the spherical portion. It is noteworthy that the aeration apparatus in accordance with the invention (a flexible air intake which is associated with a conduit network located in the spherical portion or in the comfort filling) can without going beyond the scope of the present invention be attached to a helmet with a chin strap by means by a plurality of fittings.

According to one embodiment of the helmet of the present invention, it is possible to provide a rigid or semi-rigid flap to perfect the air impermeability of the helmet during cold weather or at high speeds. Such flaps are formed from rigid or semi-rigid materials which slide between the interface of the helmet shell and the outer face of the spherical portion and can be lowered beyond the lower edge of the shell to function as air blockers and deflectors which are located between the base of the helmet shell and the bead in the zones where the flexible skirt insures that the connection between the bead and the helmet shell base will be either perforated or non-existent.

According to an embodiment of a helmet formed in accordance present invention, if it comprises at least one rigid piece which is journalled by a hinge to the shell base, it will also be equipped with a system which comprises a rigid element, e.g., a metallic wire, which forms a journal axis for the hinge, It also forms, by extending outwardly of the hinge, either a single or a double buckle which is capable of hooking onto the anti-theft systems presently in use for motorcycle helmets. Such a buckle can equally extend, independently from the hinge through orifices or through a conduit which is located in the helmet shell. However, once a hole is provided in a helmet shell it is necessary to provide onerous modifications of the mold used to form the shell. It is also necessary to provide for a split in the shell and causes air and water permeability and tightness problems for the shell. Accordingly, the preferred embodiment of the anti-theft object of the present invention is characterized by the replacement of the existing journal axis to minimize its cost and to reduce the price of the anti-theft buckle.

According to one embodiment, the anti-theft apparatus comprises a system having two buckles which form equal journal axes, and which are connected to each other by a swivel hook. The second buckle freely rotates and can be connected to anti-theft devices for helmets, which are provided on all motorcycles and which are also capable of preserving the possibility that the helmet will be oriented with respect to the motorcycle so that rain falling during a stop will not fill the helmet with water, which would be the case with the helmet facing upwardly towards the sky.

In order to improve the esthetic qualities of the helmet and to prevent the double anti-theft buckle system from producing a disagreeable metal clicking sound when the helmet is being used, an appropriate system is provided to permit the buckle assembley to be immobilized and placed against the outer surface of the helmet when it is not in use as an antitheft device. According to one embodiment, the buckle (or buckle assembly) can clip onto a raised portion or a recess of the helmet shell or of a rigid piece journalled to the shell. This anti-theft apparatus not only eliminates the shortcomings of previous helmets equipped with chin-strapless fastening apparatus, with ordinary helmets, but also improves the apparatus insofar as the anti-theft buckle is not connected to the helmet by an easily divisible chin strap.

In order to reduce manufacturing costs, according to one embodiment, the anti-theft buckle system also serves as a hinged journal axis and is adapted to fulfill the quadruple function of a journal axis, an anti-theft buckle, a locking system, and a safety lock blocking system.

According to another embodiment of the invention, the anti-theft buckle system cannot fulfill the functions of the journal axes and of the anti-theft buckle but can fulfil the function of providing a locking system and a lock blocking system.

In the same vein, in order to reduce manufacturing costs, the bead formed as a single unit which is tubular and molded from rubber, has its ends treated in layers of thick rubber. A tubular frame formed from polyamide synthetic fiber or from a semi-rigid or flexible material which is resistant to traction and shearing forces is then introduced as a tubular bead, and has threaded ends, each of which receives respective bolt sections which also serve as longitudinal abutments for the frame and which have rear surfaces which rest on each end of the rubber bead. This structure permits, during assembly, compression according to the length of a frame on which the bead is fixed. In this fashion, a single manufacturing mold can be used during assembly by selecting the length frame which it is adapted to receive, and preadjusting the length of the bead in view of its use on a small, medium, or large size helmet.

The fundamental principle of guiding the mobile elements to permit opening of the helmet between them by using flexible frames which are integral with one of the elements which slide within the other can equally be used to permit another type of helmet equipped with fastening apparatus and without a chinstrap to be formed.

Thus, according to one embodiment of such a helmet, the shell extends downwardly and towards the center of the opening defined by the base, in the form of a rigid two part skirt. At least one of the parts can slide over a plane which is parallel to the plane of the shell base and toward the exterior of the base. A sufficiently thick padding is provided on the inside of the skirt over all of its surface zones and abut the user, around whose neck it forms a collar. The connection between each sliding half-skirt and the base of the helmet sheel is reinforced in a closed position by a hook located along its entire length and by the upper ridge of the half-skirts which have a configuration which is complementary to the lower edge of the shell. In the open position and during opening and closing of the skirts, the connection and guiding motion between the shell base and each half-skirt is insured by two blades which are flexibly positioned in a plane parallel to the shell base and rigid in a curved plane extending over the surface of the shell in a manner which is substantially parallel to the lower edge of the shell and which has no other contact points with the shell except for extension points which are diametrically opposed (one on each blade) and which are substantially vertical to the shell base. They are each connected to the shell base at one end. Each blade is thus suspended at the shell base and will have, in its balanced position, a radius of curvature which is greater than the radius of curvature of the lower edge of the shell, and which approaches a rectilinear shape. The length of each blade is substantially equal to a quarter of the perimeter of the lower edge of the shell, the free end of each blade tending to be connected when the blades are brought under the lower edge of the shell. The free end of each blade is introduced into a conduit having the same cross section, to the functional sets which are located within the slideable half-skirt and which open at each of its ends. Thus, when the half-skirt is pulled toward the exterior of the helmet, it can slide about the flexible blade and will disengage from the opening of the shell while still remaining attached to the shell via the intermediate blades.

In a closed position, locking can occur between any of the following: between, the ends of each flexible blade; between the ends of each half-skirt; between the ends of each half-skirt and the extension of the shell carrying the blade against which they abut; between each half-skirt and each flexible blade; between each half-skirt and each flexible blade; or between each half-skirt and the shell base. An elastic apparatus is capable of automatically opening the half-skirt as soon as unlocking occurs.

In an open position, an abutment apparatus limits the amplitude of the path of each half-skirt and prevents the half-skirts and the flexible blade which carry it from coming apart.

According to one embodiment, the helmet according to the present invention is equipped with two sliding half-skirts, each of which occupies, within a closed position, approximately a half-circumference of the shell base. In this case, the two vertical extensions which are positioned diametrically opposite from the shell base, each carries a flexible blade which is connected to them along its central zone and has a total length essentially equal to half of the perimeter of the shell base, each of the free ends being introduced into one of the half-skirts. In the closed position the half-skirts have their ends brought together in pairs and come to rest at each end of a respective shell extension.

According to another variation, the helmet formed in accordance with the present invention is equipped with a single sliding half-skirt which occupies, when in a closed position, substantially half of the circumference of the shell base. This half-skirt is thus associated with a stationary half-skirt, which forms a shell extension, over the spherical portion and over the comfort filling, or over the spherical portion and the comfort filling individually. It can also be associated with one of the apparata described above which occupies the other half-circumference of the shell base, e.g., either the flexible or rigid portion.

According to another embodiment, each flexible blade can be replaced by a telescoping element or elements.

The shell assembly which extends the shell and the flexible blade can be formed as a single unit from the same material or can comprise pieces assembled which are made from different materials.

One particular embodiment occurs where the assembly of the chin part (which provides maxillary protection) on the helmet is positioned as part of a sliding half-skirt. In this case (as well as in the situation where one of the half-skirts is stationary), the flexible and integral blade of the sliding half-skirt are mobile and slide along conduits located in the helmet shell, which is also formed as a stationary half-skirt.

According to one particular embodiment of a helmet equipped with sliding half-skirts, the connection between the shell base of each half-skirt is formed by rod systems which are journalled in one end to one of the connecting elements and which are able to slide, at their other end, in an appropriate groove or slot or about an axis which is located in the other element. This system is complementary or is used as a replacement for the flexible blade system.

Other guiding systems can be imagined without going beyond the scope of the invention, and can be used for helmets which are equipped with fastening apparatus which comprise at least a sliding half-skirt positioned at the helmet shell base and located along a plane which is substantially parallel to the base.

BRIEF DESCRIPTION OF THE DRAWINGS

The list of variations described above should not be considered to be exhaustive of the present invention and should not be considered to limit the scope of the present application. Similarly, the embodiments of the helmet which are shown in the drawings, and which is described here inafter by way of non-limiting example, should not limit the present application. The present invention is described with in reference to the annexed drawings, in which similar reference numerals are used to describe similar parts throughout, and wherein.

DETAILED DESCRIPTION OF THE DRAWINGS

Figure 1:
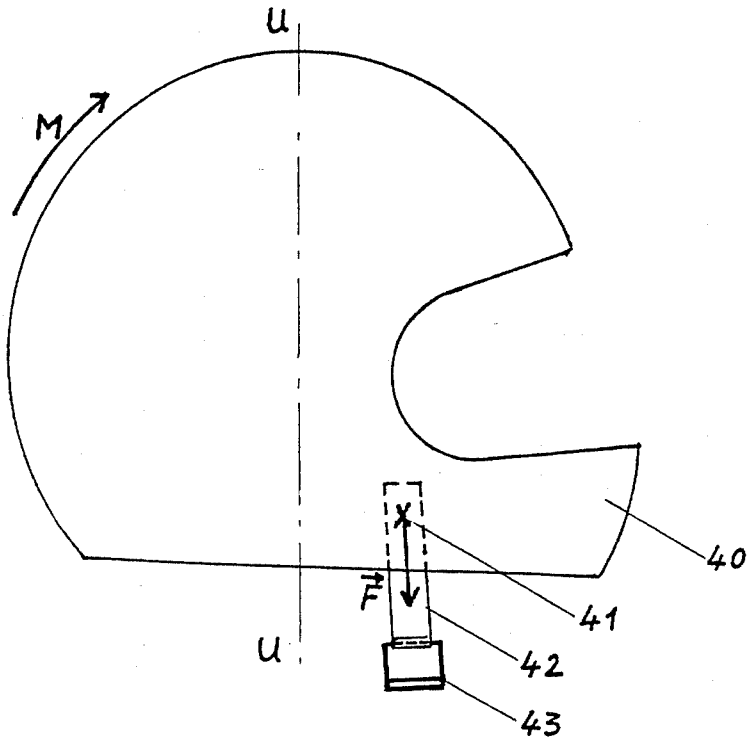
FIG. 1. PRIOR ART
FIG. 1 is a side view of a helmet equipped with a conventional chin strap fastening apparatus.

FIG. 1 illustrates a helmet 40 having a conventional chin strap 42 and a closure buckle 43. Chin strap 42 exerts, at its helmet anchoring point 41, a force F which is clearly offset with respect to plane U—U. This force F results in a torque which, when undergoing a shock, tends to lock the helmet in the direction of arrow M, which can result in the helmet coming off of the head of the user.

Figure 2:
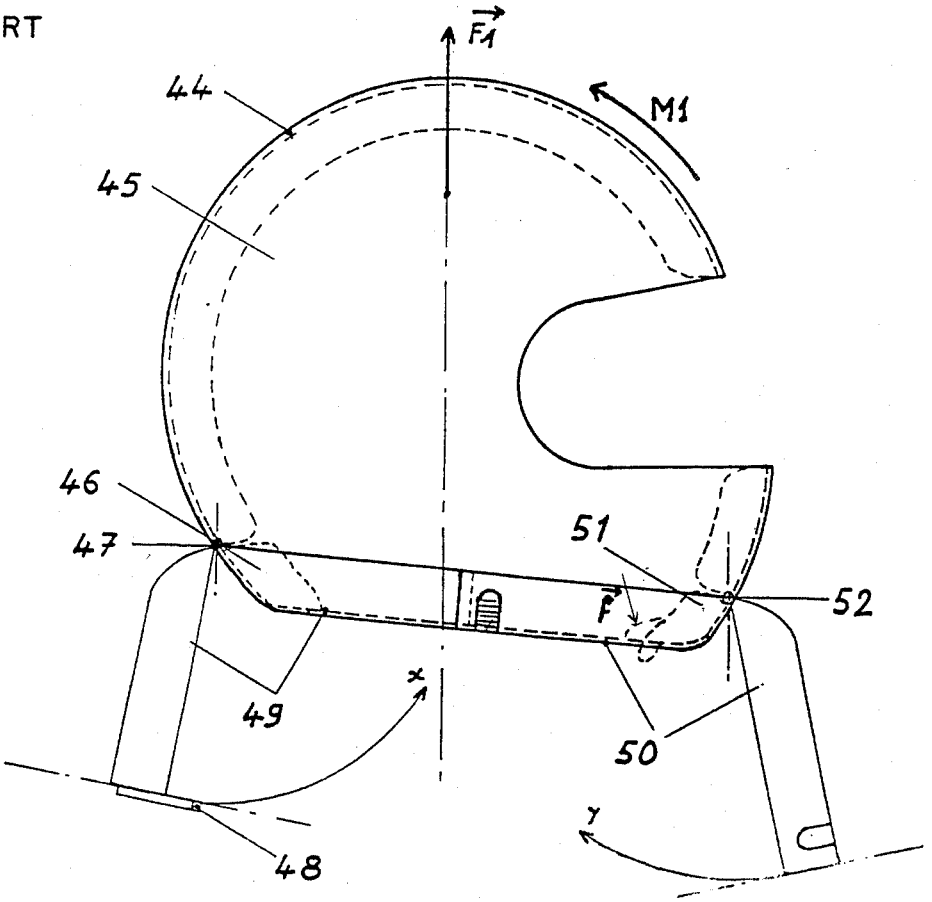
FIG. 2. PRIOR ART
FIG. 2 is a side view of a helmet equipped with a known fastening apparatus.

FIG. 2 illustrates a helmet 41 equipped with a known fastening apparatus. This fastening apparatus essentially comprises a rigid skirt which extends downwardly from the base of shell 44 and which comprises two half-skirts 49 and 50, respectively, which are journalled to the shell by hinges 47 and 52. The extent of displacement of these two half-skirts is illustrated by arrows x and y at the ends of the half-skirts, as well as by the displacement of tongue 48 (which is provided with a hook) and integrally with an end which is integral with an end of one half-skirt 49. When the helmet is subjected to removal force F1 the flexible foam bead 51 is integral with half-skirt 50 and only be deformed under the action of reaction of the force F1 which the chin of the user exerts upon it. As a result, an imperfect retention and locking of the helmet will occur in a direction of arrow M1.

FIGS. 3 through 6 illustrate the opening movement of the collar formed by the single bead 1 which insures retention of the helmet on the head of user. The movement illustrated occurs in a plane which is substantially parallel to the shell base. The user activates locking apparatus 26 and can then space the two bead ends of the journalled shell extensions, i.e. elements 2 and 3, against which they are pressed when the helmet is closed. Because flexible frame 4 is connected at a center portion, at least in translation, to element 2, and because it is able to slide within its tubular bead, its opening movement can be complete and transmitted to journalled shell extensions 2 and 3, or reciprocally by element 4. Similarly, during closure, frame 4, which is mounted concentrically to locking elements 28, which it crosses longitudinally, and to locking element 35, in which it slides, insures coincidence between cooperating bolt sections 28 and 35.

Figure 3:
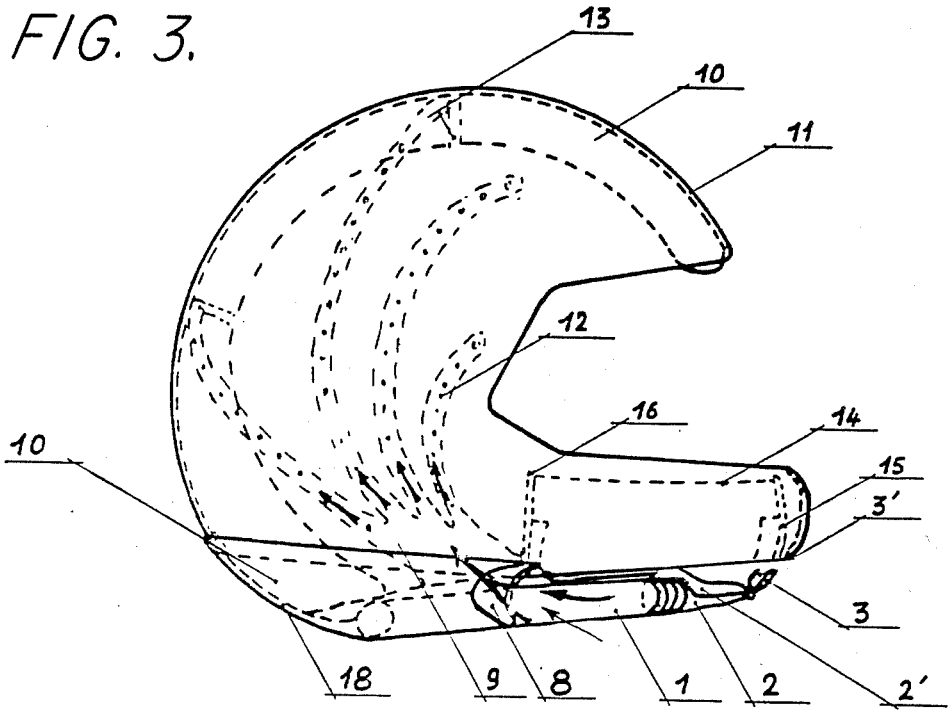
FIG. 3 is a side view of one embodiment of a helmet equipped with a fastening apparatus formed in accordance with the present invention, and which is illustrated in its closed position.

FIG. 3 schematically illustrates the manner in which the ventilation of the helmet can be assured. Air is captured by air intake 8 and flows in conduit 9 which is provided along the exterior surface of a spherical portion 10 contained in shell 11 (see FIG. 3). This conduit opens along the base of a spherical portion in alignment with air intake 8, spherical portion 10 extending along the rear portion of the helmet from the lower edge of shell 11. Air is then distributed among a plurality of conduits 12, having cross sectional areas smaller than that of conduit 10, and which extend the interior of the helmet via orifices 13, which are provided at the beginning portion of conduits 12 along the thickness of spherical portion 10.

Figure 5:
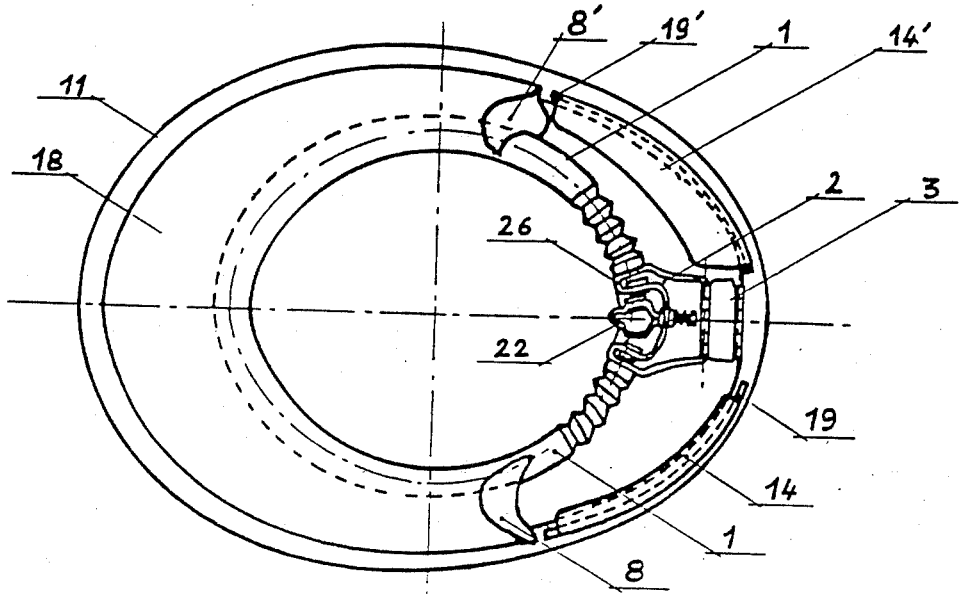
FIG. 5 is a bottom view of the helmet of FIG. 3.
Figure 6:
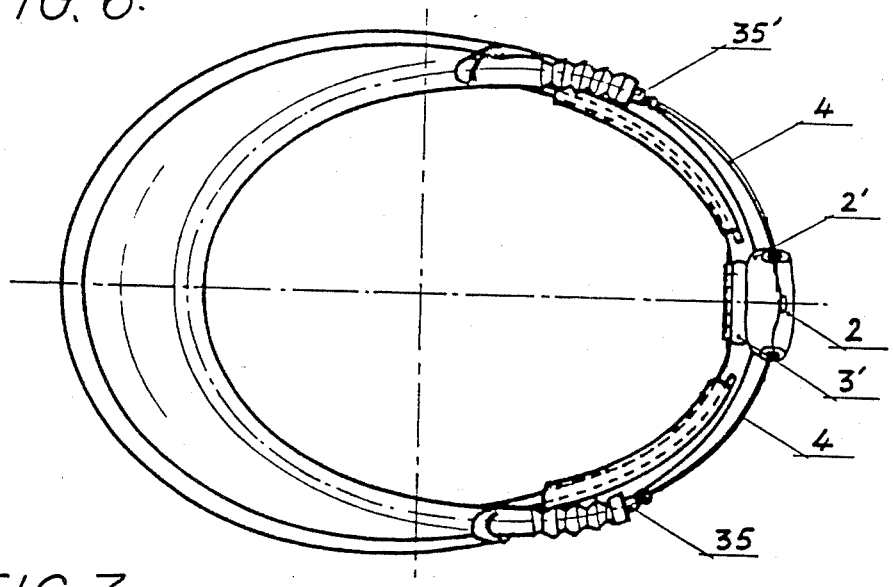
FIG. 6 is a bottom view of the helmet of FIG. 4.
Figure 7:
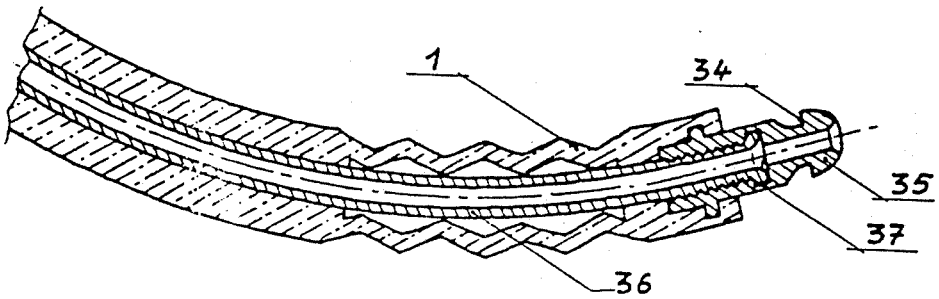
FIG. 7 is a cross-sectional view taken along a median plane of one bead end of the helmet.

FIG. 5 illustrates how each of air inlets 8 and 8; as well as a flexible flap which extends downwardly from flexible and elastic skirt 18, can be used as deflectors and air blocking elements 8' by pushing them towards the interior of the helmet. Flexible flaps 14 and 14', when pressed against the internal surface of shell 11, will slide between the interior surface of the shell and the exterior surface of spherical portion 10. When they are moved they serve as a deflectors, and a air blocks element between the shell base and the bead in zones in which skirt 18 does not exist. As illustrated in the drawings, these flaps slide between shell 11 and spherical portion 10 within the chin holder, and each passes through a slot 19 or 19' which is provided across an edge of the shell base of the helmet in a direction which is substantially perpendicular to the surface of the helmet and which is turned towards the interior of the helmet. They are similarly guided by protrusions 15 and 16, which are provided on the interior surface of the shell between which they slide. The upper portion of each flap is substantially enlarged, up to a value which is greater than the length of either of slots 19 or 19' and which abuts against the upper surface of the edge of the shell in order to limit the amount of displacement of each flap and to prevent the accidental retraction of the flap from the shell. Similarly, the displacement of the flap upwardly is limited by an edge of the lower portion of the flap. This edge also serves as a maneuvering and deflecting element. Each flap 14 and 14' is formed from a rigid or semi-rigid synthetic material.

Figure 4:
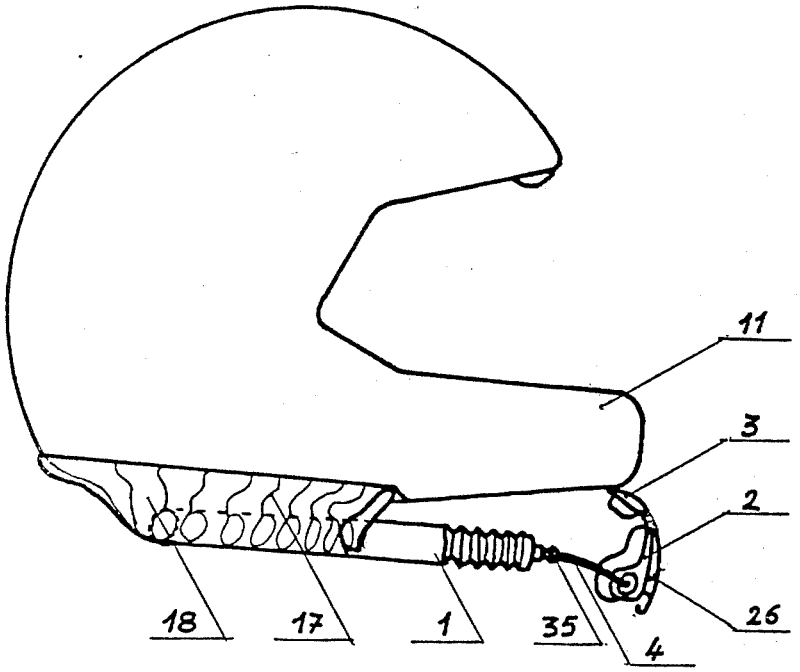
FIG. 4 is a side view of the helmet illustrated in FIG. 3, as shown in its open position.
Figure 8:
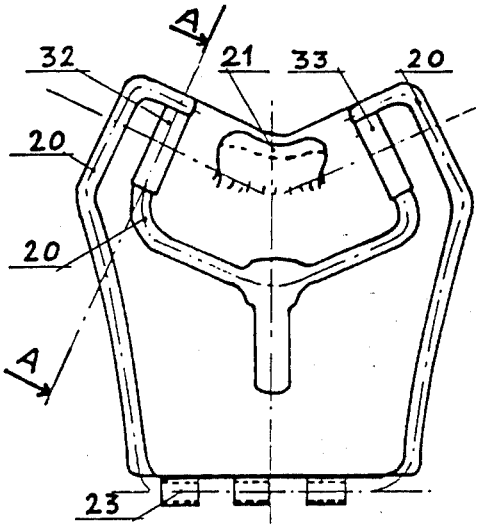
FIG. 8 is a magnified bottom view of the element which is journalled to the helmet illustrated and which includes a portion of the locking element as well as the flexible frame and the guiding element.
Figure 9:
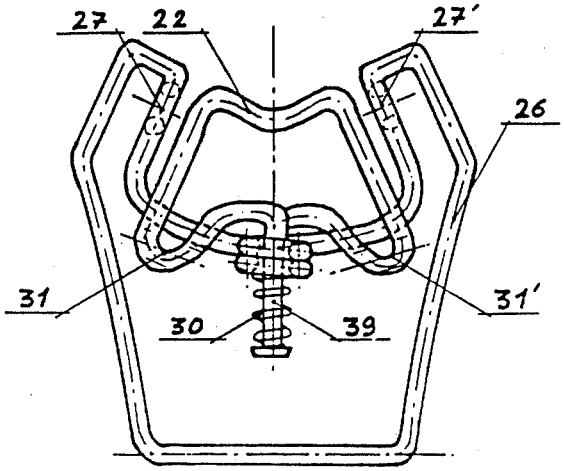
FIG. 9 is a bottom view of an anti-theft buckle system on the helmet which also serves as journal axis, a locking element, and a safety blocking system.
Figure 10:
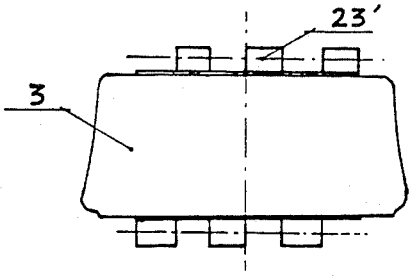
FIG. 10 is a magnified bottom view of the element which is journalled to the element illustrated in FIG. 7 on one hand, and to the helmet shell base, on the other hand.
Figure 11:
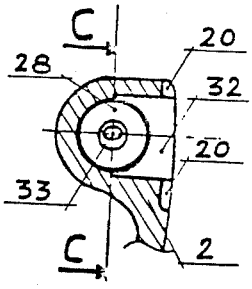
FIG. 11 is a partial cross-sectional view taken along line A—A of the element illustrated in FIG. 8.
Figure 12:
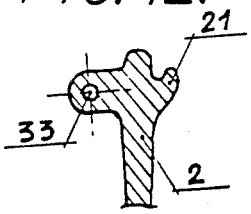
FIG. 12 is a partial sectional view taken along line B—B of the element illustrated in FIG. 13.
Figure 13:
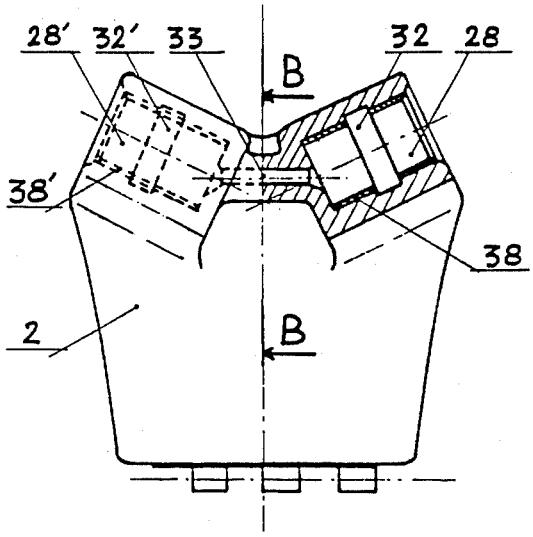
FIG. 13 is a top partial sectional view taken along line C—C of FIG. 11.
Figure 14:
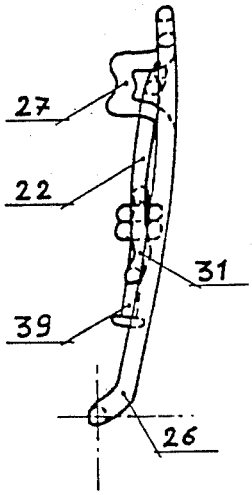
FIG. 14 is a side view of the buckle system illustrated in FIG. 9.

FIG. 4 illustrates a flexible skirt 18 which is formed from molded rubber (as is bead 1). The bead and skirt are illustrated drawn in a transparent fashion, although they are not transparent materials, in order to make it possible to view the metallic wires which reinforce them along their height, and which wrap about the bead portion. These wires are positioned in the plane of rings about the skirt, but could also form S's. In order to preserve the elasticity of the skirt it is important that they are not rectilinear. They are embedded during molding within the thickness of the skirt and similarly can be attached along the back portion of the inner surface of the skirt. Jornalled element 2 is formed from a rigid synthetic molded material. The surface of this journalled element, which faces the exterior of the helmet and which is shown in FIG. 8, has a plurality of hollow semi-cylindrical grooves 20 which make it possible to lodge or partially lodge or position metallic strands, e.g., buckle 26 as illustrated in FIG. 9, therein. Protrusion 21 forms a type of a hook in which a corresponding portion of a metallic buckle can itself be lodged. In effect, the assembly of elements which is illustrated as being isolated can be attached. The rectilinear portion of buckle 26, as shown in FIG. 9, comprises a journal axis which permits connection between elements 2 and 3, each of which carries a complementary hinged portion 23 and 23', respectively. Two small springs, in the shape of hair pins (which are not illustrated) are mounted about this axis at each of its ends. These/springs rest at one end, on the two main branchs of buckle 26, and at their other end against element 2 in order to maintain buckle assembly 22 and 26 pressed in abutment against element 2. Spring 30, which is illustrated in fine lines in FIG. 9 (and which is not illustrated in FIG. 14), maintains buckle 22 in abutment against buckle 26. Buckle 22 thus abuts the top portion of protrustion 21, in order to prevent buckle 22 from wholly coming to rest on throats 20 located in element 2. For this reason, it is important for one to pull buckle 22 by compressing spring 30 in order that protrusion 21 will be positioned in the middle of buckle 22, and so that it will not resist or prevent movement of buckle 26. Two wings are formed by buckle 22 on both sides of axis 39, and are folded so that they form projections 31 and 31' (see FIGS. 9 and 14) which slide on and are elastically deformed by the two branches of buckle 26. When buckle 22 is pulled and its projections are positioned on the outside of buckle 26, they form obstacles which counter and resist the force of spring 30, to prevent the return of buckle 22 against buckle 26. In this position, buckle 26 can to rest against element 2, tongues 27 and 27' (which are formed by buckle 26) thus passing through slots 32 and 32' in order to ensure that the helmet will be locked in the closed position and that it will be lodged within grooves 34 and 34' of both sections of 35 and 35', which are integral with each end of bead 1, when they are introduced into female cylinders 28 and 28'. These female cylinders are reinforced by metallic inserts 38 and 38' of element 2. Once locking is accomplished, the user can pull buckle 22 towards buckle 26. Protrusions 31 and 31' will enter the interior of buckle 26, and buckle 22 will engage the hook formed by projection 21, whereby spring 30 will prohibit the projection from coming out without the intervention of the user. As a result, buckle 22 being integral with buckle 26, it will be impossible to space the buckle from element 2 and similarly to proceed with unlocking, thus making it possible to open the helmet. In order for a user to open his helmet, he must pull buckle 22 until it leaves hook 21 and until projections 31 and 31' extend to the exterior of buckle 26, thereafter exerting a force on buckle 26 which will space it from element 2.

Further, when the element is not being used, it will be possible to space both buckles 22 and 26 from element 2 and to pass buckle 22 through the anti-theft hook which is provided on all modern motorcycles, so the user will not have to carry the helmet with him.

Figure 15:
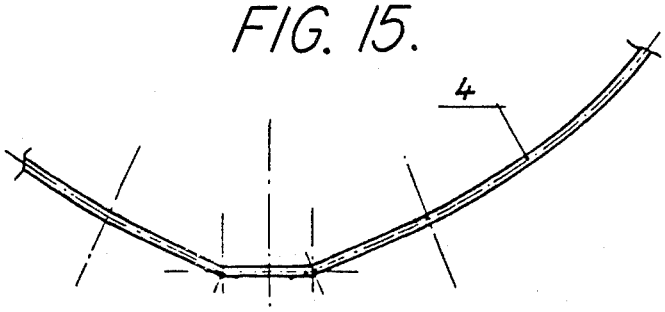
FIG. 15 is a top view of the central portion of the flexible frame and the guiding element of the helmet of FIG. 1.

Flexible frame 4 is partially illustrated in FIG. 15 and is shown as an elastic metallic element, e.g., a metallic piano type chord. Its centered zone is rectilinear and is introduced into conduit 33 of element 2. On both sides of this rectilinear portion two branches of the frame are bent; thereafter, they are again rectilinear over a length which is substantially equal to the length of cylinders 28 and 28', in order to confuse their axes with the cylinders in the zone where these branches traverse. Beyond these lengths, the two branches of frame 4 are bent along a radius of curvature which is substantially equal to the radius of curvature of the bead in its open position. This is in order that when the unlocking of the bead has begun to occur, the branches will tend to automatically open the bead.

The total length of the frame is slightly less than the perimeter of the closed bead, and its ends are rounded only to facilitate their sliding within the bead. Bead 1 is formed of molded rubber together with skirt 18, and upon leaving the mold has a single length used for all helmet sizes. On the other hand, the polyamide synthetic fiber 36 has a different length for each helmet size. In fact, the manufacturer, at the time of assembly, selects an adequate length frame 36, introduces it into bead 1, and attaches a bolt section 35 to each of its ends. A tubular portion has a central conduit with a diameter equal to that of the polyamide synthetic fiber. Screwing the bolt section on frame 36 on compresses bead 1, which is treated at its end with layers of thick rubber and which can therefore undergo such compression without damage until it reaches the desired length, element 35 being completely screwed in at that point. It is possible to block these elements by pushing back the ends of frame 36 in grooves 37, which are provided for such purpose in element 35.

The thus completed bead flap assembly is then mounted on the helmet. Each end of flexible frame 4 is already mounted in element 2 and then engaged in a respective bead end 35. Thereafter, element 3 and the shell base are connected by introducing a cylindrical journalled axis. The helmet shell is then ready for operation and use.

In all of the figures referred to above, and for greater clarity in the drawings, the padding portions which cover the entire inner surface of the bead are not shown. Similarly, the interior surfaces of elements 2 and 3 are each covered with padding portions 3' and 2', respectively, which are visible only in FIGS. 3, 5, and 6. It should be noted that the scope of the present application should in no case be limited to the embodiment described herein purely by way of illustration.

I claim:

1. A protective motorcycle helmet including a retention apparatus for enhancing the position and maintenance of said helmet on a user, said apparatus comprising:

(a) a helmet shell having a base and an opening positioned along said base;

(b) a collar which is substantially concentric with said shell base opening, said collar having a constant circumference when said helmet is locked in a closed position and being opened along at least one portion of said circumference to permit said helmet to be positioned on the head of the user and removed from the head of the user; and (c) at least one flexible element connected to said helmet shell, said element having first and second ends and being connected at one end to said helmet shell and at said second end to said collar, said flexible element extending from at least one portion of said circumference of said collar, said at least one flexible element connecting said collar to said base and comprising means for absorbing a shock exerted on a section of said collar which causes relative movement of said collar with respect to said helmet shell.

2. A protective helmet in accordance with claim 1 wherein said collar is flexible.

3. A protective helmet in accordance with claim 1 wherein said collar is semi-rigid.

4. A protective helmet in accordance with claim 1 wherein said collar is rigid.

5. A protective helmet in accordance with claim 1 comprising a plurality of flexible elements positioned about the circumference of said helmet shell base.

6. A protective helmet in accordance with claim 1 wherein said collar is formed from a flexible and elastic material having a flexible core, said collar having first and second ends, each of said first and second collar ends comprising a plurality of layers of thick rubber.

7. A protective helmet in accordance with claim 6 further comprising at least one flexible frame comprising means for facilitating opening and closing of said collar, said frame being adapted to specially slide within a hollow portion of said collar.

8. A protective helmet in accordance with claim 7 wherein said frame is attached to one end of said collar.

9. A protective helmet in accordance with claim 1 wherein said frame comprises two members attached to each other telescopically, said helmet further comprising an abutment apparatus which comprises means for preventing said two frame elements from separating, said abutment apparatus comprising a spring which when relaxed retains said frames in a stationalry rest position.

10. A protective helmet in accordance with claim 1 wherein said collar comprises a plurality of sections which are adapted to occupy a rest position in which they are positioned in abutting end to end relationship when the helmet is closed and which are adapted to be separated from each other when said collar is open to permit the positioning of the helmet on a user and the removal of a helmet from a user.

11. A protective helmet in accordance with claim 1 further comprising a locking system attached to one end of said collar, said locking system being adapted to cooperate with a complementarily shaped portion attached to the second end of said means.

12. A protective helmet in accordance with claim 1 further comprising a locking system attached to one end of said collar, said locking system being adapted to cooperate with a complementarily shaped portion attached to one end of a flexible frame.

13. A protective helmet in accordance with claim 1 further comprising a locking system attached to one end of said collar, said locking system being adapted to cooperate with a complementarily shaped portion attached to an extension journalled on said shell.

14. A protective helmet in accordance with claim 1 further comprising a locking system attached to one end of said collar, said locking system being adapted to cooperate with a complementarily shaped portion attached to an extension point flexibly attached to said shell.

15. A protective helmet in accordance with claim 7 wherein an end of said flexible frame cooperates with a complementarily shaped section attached to a second end of said frame.

16. A protective helmet in accordance with claim 15 wherein a portion of each of said locking apparatus comprises a male cylinder including a circular groove and a beveled portion.

17. A protective helmet in accordance with claim 16 further comprising a female cylinder adapted to cooperate with said male cylinder, said female cylinder being attached to a second portion of said locking apparatus and comprising a transverse slot adapted to receive a spring-biased tongue, whereby when said spring-biased tongue is inserted into said groove of said male cylinder it comprises means for preventing said male and female cylinders from being separated.

18. A protective helmet in accordance with claim 17 wherein said tongue extends to the exterior of said female cylinder and wherein said male and female cylinders are adapted to be separated by pulling said tongue from said groove.

19. A protective helmet in accordance with claim 1 wherein said collar has a flexible core and further comprising means for connecting said first and second ends of said collar which have tubular bolts attached thereto for connecting said first and second collar ends.

20. A protective helmet in accordance with claim 1 wherein said helmet shell base is attached to said collar by an elastic, flexible flap comprising an extension of said helmet shell base.

21. A protective helmet in accordance with claim 20 wherein said flap is solid.

22. A protective helmet in accordance with claim 20 wherein said flap is perforated.

23. A protective helmet in accordance with claim 20 wherein said flap comprises a unitary member.

24. A protective helmet in accordance with claim 20 wherein said flap comprises a plurality of attached sections.

25. A protective helmet in accordance with claim 20 wherein said flap includes at least one flexible elastic reinforcement.

26. A protective helmet in accordance with claim 25 wherein said flexible and elastic reinforcing elements comprise material ribbons.

27. A protective helmet in accordance with claim 29 wherein said reinforcing elements comprise a plurality of flexible metallic wires connecting said helmet base to said collar over a non-rectilinear path.

28. A protective helmet in accordance with claim 20 wherein said flexible flap extends along the exterior of said shell over the entire outer peripheral suface of said shell.

29. A protective helmet in accordance with claim 20 wherein said collar and said shell base are connected to each other at at least one point by at least one flexible element.

30. A protective helmet in accordance with claim 29 wherein said flexible element comprises a material ribbon.

31. A protective helmet in accordance with claim 29 wherein said collar and said shell base are attached to each other by an assembly of rigid pieces journalled to each other and journalled to said shell base.

32. A protective helmet in accordance with claim 1 wherein the height of said collar with respect to the height of said shell base is adjustable, wherein said collar and said shell base are attached to each other by a plurality of adjustable connecting elements.

33. A protective helmet in accordance with claim 1 wherein the circumference of said collar is adjustable in accordance with the individual morphology of the user.

34. A protective helmet in accordance with claim 1 further comprising at least one air inlet formed by a small flexible flap opening towards the front of said helmet and which is adapted to be pushed inwardly of said helmet.

35. A protective helmet in accordance with claim 34 wherein said valve also comprises an air deflectgor and blocker when it is pushed toward the inner surface of said helmet to cover an aperture in said helmet.

36. A protective helmet in accordance with claim 34 further comprising a spherical portion having a plurality of conduits therein, said spherical portion being positioned within said shell.

37. A protective helmet in accordance with claim 36 further comprising at least one flap slidably positioned between an inner surface of said shell and an exterior surface of said spherical portion, said inner and exterior surfaces together defining a guide for said sliding motion of said rigid flap, said flap comprising means for deflecting and blocking air when it is lowered outside of said shell and means for permitting reinforcement of said skirt when it is retracted in said shell.

38. A protective helmet in accordance with claim 37 wherein said flap is rigid.

39. A protective helmet in accordance with claim 37 wherein said flap is semi-rigid.

40. A protective helmet in accordance with claim 1 further comprising an anti-theft device comprising at least one metallic buckle system incorporating two metallic buckles attached to each other by a swivel hook, each one of said buckles being formed by a rectilinear section of metallic wire which also serves as the journal axis for a hinge attached to said helmet shell.

41. A protective helmet in accordance with claim 40 wherein each of said metallic wires comprises means for locking said buckles to each other and for preventing locking of said buckles.

* * * * *